United States Patent [19]

Piber

[11] 4,276,461

[45] Jun. 30, 1981

[54] ADJUSTABLE TRIGGER STOP

[75] Inventor: Earl T. Piber, Oconomowoc, Wis.

[73] Assignee: Eaton Corporation, Cleveland, Ohio

[21] Appl. No.: 90,116

[22] Filed: Nov. 1, 1979

[51] Int. Cl.[3] ..... H01H 9/06

[52] U.S. Cl. ..... 200/329; 200/321; 200/157

[58] Field of Search ..... 200/157, 318, 321, 328, 200/329, 334; 74/526; 338/198, 200; 318/345 R, 345 C, 345 G, 346

[56] References Cited

U.S. PATENT DOCUMENTS

| | | | |
|---|---|---|---|
| 3,238,797 | 3/1966 | Coughren | 74/55 |
| 3,359,810 | 12/1967 | Hansen | 74/60 |
| 3,515,832 | 6/1970 | Martin | 200/291 |
| 3,548,136 | 12/1970 | Frenzel | 200/157 |
| 3,575,560 | 4/1971 | Mayer | 200/157 |
| 3,603,757 | 9/1971 | Sahrbacker | 200/157 |
| 3,761,663 | 9/1973 | Brown | 200/157 |
| 4,132,933 | 1/1979 | Barcz et al. | 318/346 |

*Primary Examiner*—John W. Shepperd
*Attorney, Agent, or Firm*—R. J. McCloskey; H. R. Rather

[57] ABSTRACT

A portable electric tool speed control switch of the trigger actuated type having an adjustable trigger stop that affords selective setting of the maximum speed point to any one of a multiplicity of speed points. The trigger stop is integrally mounted in the trigger and abuts the switch housing to limit trigger depression. A spring-biased plunger pin (16) extends rearwardly through the trigger head (10) toward the housing and an adjusting knob (20) recessed in and rotatably mounted in the trigger head has a notched helical track (20*b*) that engages a tooth at the head of the pin so that rotation of the knob adjusts the plunger pin to provide a trigger stop by abutting the housing at the selected point of trigger depression thus setting the speed point of the tool and affording returning repeatedly to the same speed point.

8 Claims, 6 Drawing Figures

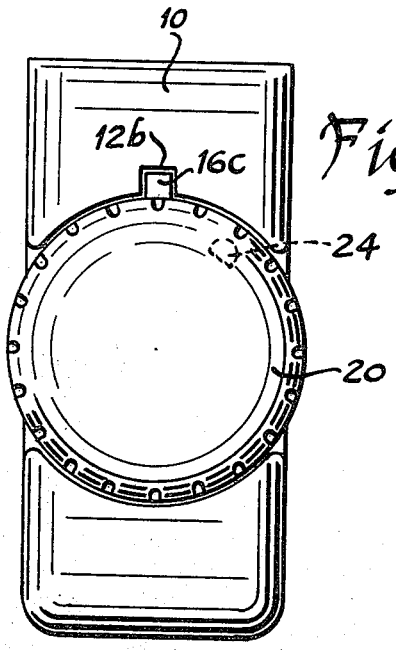
Fig. 1
Fig. 3
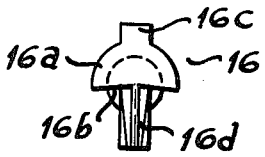
Fig. 4
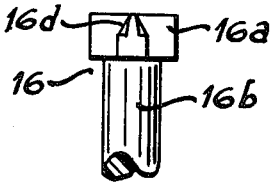
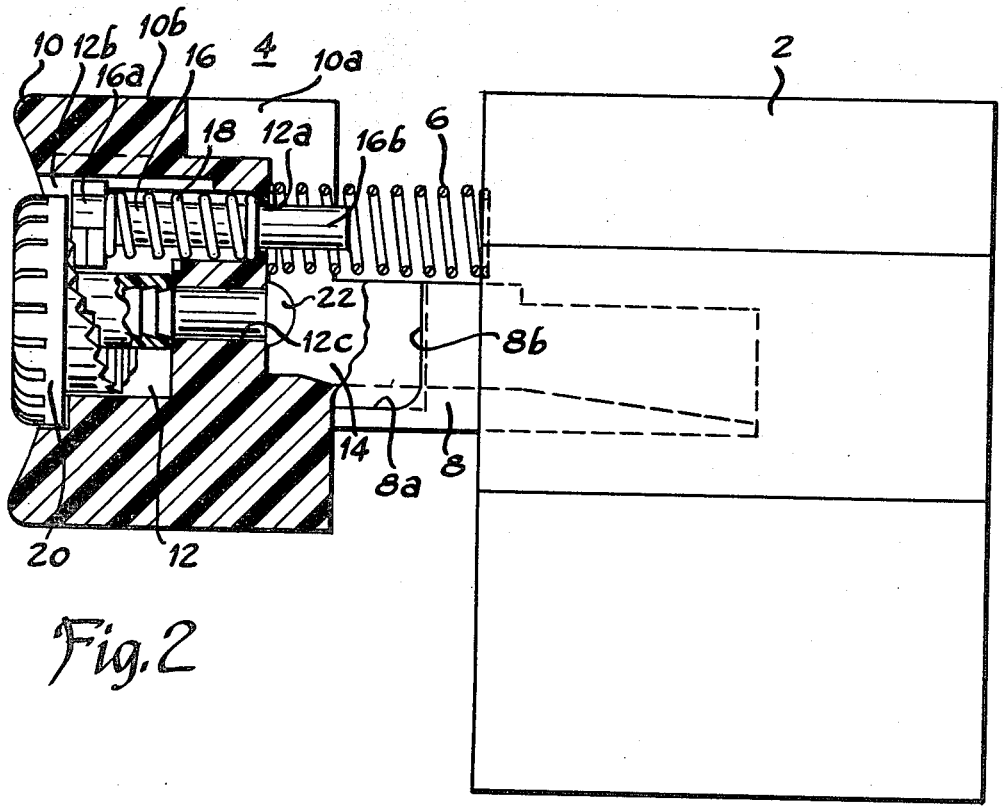
Fig. 2

ADJUSTABLE TRIGGER STOP

BACKGROUND OF THE INVENTION

Adjustable trigger stops for limiting the depression stroke of a trigger for portable tool speed control purposes have been known heretofore. For example, C. J. Frenzel U.S. Pat. No. 3,548,136, dated Dec. 15, 1970, shows several versions of an adjustable trigger stop including a one-intermediate-trigger-position rotary stop in FIGS. 1–4, a two-intermediate-trigger-positions slidable stop in FIGS. 5–6, a two-intermediate-trigger-positions rotary stop in FIGS. 7–8, a one-intermediate-trigger-position pivoted lever stop in FIGS. 9–10, and a one-intermediate-trigger-position rotary stop in FIGS. 11–12, all of these having a rather limited trigger positioning capability, that is, only one or two adjustable positions between no trigger depression and full trigger depression. E. V. Sahrbacker U.S. Pat. No. 3,603,757, dated Sept. 7, 1971, shows an adjustable trigger stop construction wherein the finger-engaging part of the trigger which provides the trigger stop abutting the housing, is secured to and adjusted relative to the slidable part of the trigger by a setscrew having a knob for manual adjustment. While this construction provides a stepless adjustment of the depth of trigger depression, the structure is rather fragile since the external part of the trigger is secured only by the setscrew which could be damaged if the trigger is bumped or the tool dropped. H. W. Brown U.S. Pat. No. 3,761,663, dated Sept. 25, 1973, shows an adjustable trigger stop which also can be adjusted by a rotary knob embedded partially in the face of the trigger. In this version, an eccentric pin on the adjustment shaft raises a stop block to abut the switch frame. This version also has limited trigger positioning capability.

While these prior structures have been useful for their intended purposes, this invention relates to improvements thereover.

SUMMARY OF THE INVENTION

An object of the invention is to provide an improved trigger speed control switch.

A more specific object of the invention is to provide an improved adjustable trigger stop for a speed control switch.

Another specific object of the invention is to provide and adjustable trigger stop for a speed control switch that provides a multiplicity of a selective positions and is simple and strong in construction.

A further specific object of the invention is to provide an adjustable trigger stop of the aforementioned type that has a minimum number of parts and is easy to assemble.

Other objects and advantages of the invention will hereinafter appear.

BRIEF DESCRIPTION OF THE DRAWINGS

FIG. 1 is an enlarged front view of an adjustable stop trigger showing the adjusting button and the key and keyway of the stop plunger pin;

FIG. 2 is an enlarged center-line cross-sectional view of the head of the trigger of FIG. 1 showing the adjustable stop parts assembled along with a left side elevational view of the slide part of the trigger and switch housing;

FIG. 3 is a front view of the stop plunger pin shown in left side view of the trigger assembly of FIG. 2 showing its detent ridge or tooth;

FIG. 4 is a bottom view of the stop plunger pin of FIG. 3 further showing the shape of its detent ridge;

DESCRIPTION OF THE PREFERRED EMBODIMENT

Figure 5:
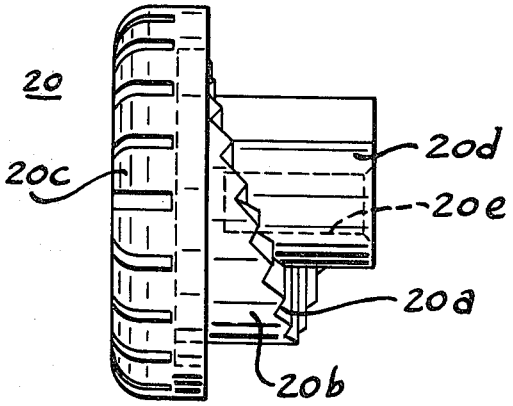
FIG. 5 is an enlarged left side elevational view of the adjusting button used in the switch of FIG. 2 showing its one-turn inclined, helical, notched surface or track for coacting with the detent ridge of the plunger pin.

Referring to FIGS. 1 and 2, there is shown an adjustable trigger stop for a speed control switch constructed in accordance with the invention. As shown in FIG. 2, this speed control trigger switch is provided with a housing 2 for enclosing the switch contacts and speed control circuit in known manner such as, for example, that shown in J. P. Barcz et al U.S. Pat. No. 4,132,933, dated Jan. 2, 1979. A slidable switch operating lever such as a molded slidable trigger 4 extends forwardly from the housing by the force of a trigger return spring 6 and is depressible against the force of this helical return spring by the forefinger of the user. As the trigger is depressed, the switch contacts are closed and further depression thereof causes the speed control means to be varied to increase the speed of the tool which may be a portable electric drill or the like powered by an electric motor.

This trigger is provided with a shaft or slidable portion 8 that extends into housing 2 and an integral head or manually engagable portion 10 that in normal use extends exteriorly from the tool handle for depression by the forefinger of the user. Slidable portion 8 is partly visible in its extended position in FIG. 2. The internal part of this slidable portion has or carries means for actuating the switch contacts as well as means for varying the speed control means in known manner. The left side of this slidable portion 8 has a recess **8*a* with an undercut rear edge 8*b*** to serve as a catch for a trigger lock mechanism such as, for example, that shown in the aforementioned H. W. Brown patent. Such lock mechanism holds the trigger in fully depressed "on" position and is spring-biased so that a slight depression of the trigger releases the lock allowing the trigger to return to its extended "off" position.

Slot **10*a* at the top of external portion 10 of the trigger having a dividing finger 10*b*** extending from the forward end thereof centrally partway toward the rear is a conventional reversing lever interlock that prevents lateral movement of the reversing lever when the trigger is in its depressed position as shown, for example, in E. T. Piber U.S. Pat. No. 4,100,383, dated July 11, 1978. Such interlock limits manipulation of the reversing switch to the time that the trigger speed control switch is off.

An integral trigger stop mechanism that is adjustable is built into the manually engagable head 10 of the trigger as shown in FIG. 2. This stop mechanism is mounted in a molded cavity 12 extending rearwardly from the front face of the trigger, there being also a long slot 14 extending from the rear end of slidable portion 8 of the trigger all the way therethrough and partway into head 10 as shown in FIG. 2 to facilitate securing of the stop mechanism in its forward cavity as hereinafter described. This slot 14 also provides a channel for a switch operating member in use.

This adjustable stop mechanism comprises stop means and adjustment means. The stop means consists of a plunger pin 16 and a helical bias spring 18. As shown in FIGS. 2–4, this plunger pin has an enlarged head 16*a* on its forward end and a round shaft 16*b* extending rearwardly therefrom and slidably through a round hole 12*a* in enlarged portion 10 of the trigger so that its rear end will abut the housing 2 when the trigger is depressed a preset amount. The upper part of this head of the stop pin has a key 16*c* shown in FIG. 3 that slides in a keyway 12*b* as shown in FIGS. 1 and 2 to keep the stop pin from turning and to maintain the stop pin in indexing relation with the adjusting knob as hereinafter described. The lower part of this head of the stop pin has a tapered detent ridge or tooth 16*d* as shown in FIGS. 3 and 4 for complementary detenting with the correspondingly tapered notches 20*a* in the helical track 20*b* of adjustment knob 20 hereinafter described in connection with FIGS. 6 and 7. As shown in FIG. 3, this tooth extends from the center of shaft 16*b* radially downwardly directly opposite to key 16*c*. As shown in FIG. 4, this tooth has flatter side angles at its root at the center of the pin shaft and tapers therefrom to steeper side angles at its tip to match the complementary-shaped notches in the adjustment track on the knob. Helical compression spring 18 surrounds pin shaft 16*b* between its head 16*a* and the rear end of cavity 12 to bias the tooth 16*d* against the corresponding notch 20*a* of the adjustment track as shown in FIG. 2.

Figure 6:
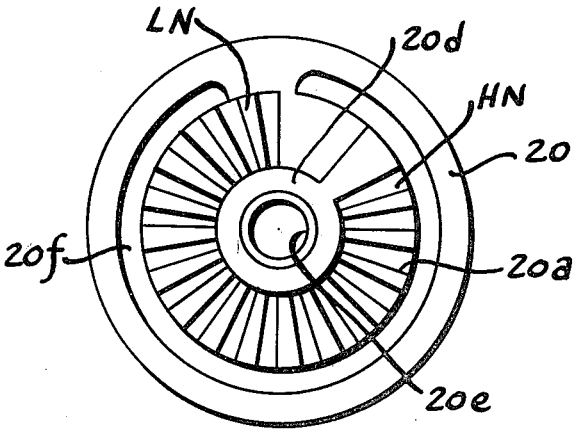
FIG. 6 is a rear view of the adjusting button of FIG. 5 showing the almost one-turn angle of the helical, notched surface.

The adjustment knob shown in FIGS. 5 and 6 comprises an enlarged, round knob head 20*c* recessed within the profile of the trigger and extending partway forwardly of the rearwardly-curved surface of the trigger and being grooved to afford turning thereof by the user. To facilitate such turning adjustment, this knob is large enough in diameter to project slightly beyond the left and right sides of the trigger as shown in FIG. 1 so that it can be gripped by the fingers and rotated. An integrally-molded hub 20*d* extends rearwardly from this knob head and is provided with a blind hole 20*e* extending forwardly thereinto to receive the shank of a headed mounting pin 22 whereby to journal this adjustment knob in the trigger. For this purpose, round mounting pin 22 is provided with a head at one end and a serrated portion on its shank at its other end and extends through a round hole 12*c* at the center of the trigger with its serrated end portion pressed into blind hole 20*e* in the hub of the adjustment knob 20 as shown in FIG. 2. In this manner, knob 20 is rigidly secured to pin 22 while allowing rotation of the knob and its pin in unison in the trigger.

Immediately surrounding hub 20*d* is a helical notched track 20*b*. As shown in FIGS. 5 and 6, this track extends from a low notch LN counterclockwise over three-fourths of a revolution to a high notch HN to provide a multiplicity of stepped adjustment notches of the order of sixteen for setting the stop plunger pin at the desired extension. The low notch LN is at the rear surface of the knob and the high notch is at or near the rear end of the hub. Consequently, counter-clockwise rotation of the adjusting knob will gradually depress the stop pin in a multiplicity of small steps to increasingly limit the trigger depression with the notches in this track intimately engaging the tooth on the stop pin to retain the adjustment at any desired setting.

The trigger and adjusting knob are provided with means for limiting rotary movement of the knob in both the clockwise and counter-clockwise directions. This means comprises a circular interrupted-ring groove 20*f* in the rear surface of the head of the adjusting knob directly around helical track 20*b* that extends almost all the way around but has an interruption adjacent low notch LN as shown in FIG. 6. This means also comprises a complementary stop lug 24 integrally molded on the trigger as shown in dotted lines in FIG. 1 that traverses groove 20*f* and abuts one or the other end of this groove to limit the knob rotation to the usable angle.

This adjustable trigger stop may be assembled by threading stop pin 16 through its helical bias spring 18 and then inserting the rear end of this stop pin into its slide hole 12*a* in the trigger, making sure that key 16*c* enters its keyway 12*b* in the trigger. While holding the stop pin in place and pressing it against its bias spring, adjusting knob 20 is inserted into cavity 12 over the stop pin head preferably oriented angularly so that low notch LN lines up with tooth 16*d* of the stop pin. While holding the adjusting knob in place, mounting pin 22 is inserted through hole 12*c* and pressed into the blind hold in the hub of the adjusting knob to a depth that takes up all unnecessary play but yet allows free rotation of the adjusting knob and mounting pin subassembly in hole 12*c* in the trigger.

When so assembled, it can be seen that the trigger can be depressed to a depth where the stop pin abuts the front wall of the switch housing. The normal position of the adjusting knob is such that high notch HN engages the stop pin and extends it rearwardly its maximum distance, thus affording maximum limitation of trigger depression for low speed operation of the tool. From this state, clockwise rotation of the adjusting knob increases the allowable trigger depression and speed of the tool motor.

While the apparatus hereinbefore described is effectively adapted to fulfill the objects stated, it is to be understood that the invention is not intended to be confined to the particular preferred embodiment of adjustable trigger stop for a trigger speed control switch disclosed, inasmuch as it is susceptible of various modifications without departing from the scope of the appended claims.

We claim:

1. In an electric switch having a housing enclosing electric power control means including an actuatable switch operating lever extending from said housing, an integral adjustable stop for selecting any one of a multiplicity of operating positions to which said switch operating lever may be actuated comprising:

a spring-biased stop member mounted within said operating lever for movement toward said housing thereby to vary the amount that said switch operating lever may be actuated before said stop member abuts said housing;

a rotary adjusting member mounted in said switch operating lever and comprising a sloping track engaging said spring-biased stop member;

and said spring-biased stop member and said sloping track of said rotary adjusting member having interengaging means for adjusting and retaining said spring-biased stop member in any one of a multiplicity of abutment positions relative to said housing according to the direction and amount of rotation of said rotary adjusting member.

2. The integral adjustable stop claimed in claim 1, wherein:

said switch operating lever and said spring-biased stop member comprise a key and keyway therebetween for confining said spring-biased stop member for linear movement toward said housing and to prevent rotary movement thereof when said adjusting member is rotated.

3. The integral adjustable stop claimed in claim 1, wherein:

said sloping track of said rotary adjusting member has a helical configuration.

4. The integral adjustable stop claimed in claim 3, wherein:

said helical track on said rotary adjusting member extends almost through one revolution thereof.

5. The integral adjustable stop claimed in claim 3, wherein:

said rotary adjusting member and said switch operating lever comprise a lug and groove therebetween for limiting rotation of said adjusting member in opposite directions.

6. The integral adjustable stop claimed in claim 5, wherein:

said groove is on said rotary adjusting member directly around the base of said helical track and said lug is on said switch operating lever.

7. The integral adjustable stop claimed in claim 3, wherein:

said inter-engaging means comprise a tooth on said stop member and complementary notches on said spiral track, both having angular cam sides.

8. The integral adjustable stop claimed in claim 7, wherein:

said notches on said helical track are radially elongated and tapered and arranged alongside one another along said spiral track;

and said tooth on said stop member has a complementary elongation and taper for close-fitting engagement in said elongated and tapered notches to retain said rotary member in any selected position of adjustment.

* * * * *